United States Patent [19]

Vrooman et al.

[11] Patent Number: 4,953,664

[45] Date of Patent: Sep. 4, 1990

[54] ERGONOMICALLY DESIGNED CHECK-OUT COUNTER SYSTEM FOR SUPERMARKET AND MERCHANDISING INDUSTRIES

[75] Inventors: Carll D. Vrooman; Dennis R. Taylor, both of Hartsville, S.C.

[73] Assignee: Sonoco Products Company, Hartsville, S.C.

[21] Appl. No.: 347,757

[22] Filed: May 4, 1989

[51] Int. Cl.[5] ..... A47F 9/04; A63F 9/02

[52] U.S. Cl. ..... 186/59; 186/61; 186/66; 186/68; 186/69; 53/391; 52/126.5; 297/143; 297/345; 248/99

[58] Field of Search ..... 186/52–69; 108/143, 102; 297/142, 143, 257, 345; 248/918–920, 298, 99; 312/140.1, 140.2, 140.3, 140.4; 53/390, 391; 52/126.5, 126.6, 126.7; 206/806, 554; 198/804, 632, 618; 235/383; 187/9 R

[56] References Cited

U.S. PATENT DOCUMENTS

| | | | |
|---|---|---|---|
| 2,964,134 | 12/1960 | Bisen | 186/66 |
| 3,186,515 | 6/1965 | Potrafke | 186/59 |
| 3,564,814 | 9/1968 | Graveley . | |
| 3,960,420 | 6/1976 | Speraw et al. | 186/66 X |
| 4,256,336 | 5/1981 | Foster | 186/66 |
| 4,512,540 | 4/1985 | Stroh | 248/99 X |
| 4,618,032 | 10/1986 | Woolf | 186/68 X |
| 4,662,680 | 5/1987 | Dauphin | 297/345 X |
| 4,676,378 | 6/1987 | Baxley et al. | 206/554 |
| 4,732,089 | 3/1988 | Mueller | 108/143 X |
| 4,750,694 | 6/1988 | Bateman | 248/99 X |

FOREIGN PATENT DOCUMENTS

| | | | |
|---|---|---|---|
| 2907642 | 8/1980 | Fed. Rep. of Germany | 186/68 |
| 2922945 | 12/1980 | Fed. Rep. of Germany | 297/142 |
| 926550 | 5/1963 | United Kingdom | 186/67 |

*Primary Examiner*—Kevin P. Shaver

*Attorney, Agent, or Firm*—Bell, Seltzer, Park & Gibson

[57] ABSTRACT

An ergonomically designed check-out counter system for supermarket and merchandising industries is characterized by provisions for differences in human heights, hand and position of operators and for ease in handling of merchandise to reduce fatigue and injury to the operators while providing maximum productivity under both light and heavy through put requirements. The check-out counter system includes one or more of the features of a housing defining the overall shape of the check-out counter system, a movable floor device positioned under an intermediate opening in the housing for receiving the cashier and for moving vertically up and down to position the cashier at a desired height regardless of the human height of the cashier, a movable chair device positioned in the intermediate opening for receiving the cashier and including adjustment devices for moving the chair vertically and horizontally to desired positions and provide the cashier with the option of sitting or standing, a keyboard device for entering price data of the merchandise which may be moved back and forth to accommodate right-handed and left-handed cashiers, and merchandise bagging devices for easy handling and bagging of the merchandise after checking-out by the cashier and providing for direct bagging by the cashier or bagging by a bagger.

22 Claims, 6 Drawing Sheets

ERGONOMICALLY DESIGNED CHECK-OUT COUNTER SYSTEM FOR SUPERMARKET AND MERCHANDISING INDUSTRIES

FIELD OF THE INVENTION

This invention relates to an ergonomically designed check-out counter system for supermarket and merchandising industries characterized by provisions for differences in human heights, hand and position of operators and for ease in handling of merchandise to reduce fatigue and injury to operators while providing maximum productivity under both light and heavy through put requirements.

BACKGROUND OF THE INVENTION

Within the supermarket and merchandising industries, many different styles of check-out counter systems are in use. With increasing labor costs and improved data systems, the pressure for productivity at the check-out location of these industries has increased dramatically.

In the late 1970s, mechanical cash registers were being replaced by integrated points of sales terminals, leading to different work procedures, increased work rates, and reduced labor requirements. Significant gains in productivity were realized. The resulting check-out counter systems have been typically designed to move products and to provide the customer with needed services. However, little attention has been given to the cashiers who have operated these check-out counter systems. The human doing the job is required to adapt to the system. Apparent incompatibilities between the cashier, the work procedures and the check-out counter design have led to increased health complaints and workers' compensation claims and disability lawsuits. The major time loss claim is due to over exertion leading to strains and sprains of the lower back and upper extremities. The real tragedy is that many workers in this environment are suffering from permanently disabling injuries.

It is only in recent years that certain of these injuries have been identified as work related. Biomechanical studies indicate that the lower back is vulnerable to continual over stress damage during even moderate load handling, but that the symptoms may not manifest themselves until later in life. Carpal tunnel syndrome—a present day "buzz word" in this industry—and related injuries such as tendinitis, tenosynovitis and De Quervain's Disease are apparently caused by injuries which build up gradually over time before symptoms begin to appear. Tasks which are highly repetitive in nature dramatically increase the risk of injury. Fatigue also appears to be one of the underlying causes of many of the symptoms experienced by cashiers at check-out counter systems. There are many human factors affecting the task performed at check-out counter systems, but there is little "hard" data to work with. It is known that certain repetitive tasks have the potential to cause cumulative trauma disorders, but critical levels of repetitiveness have not been determined, and critical force levels are not known. Although some individuals are far more susceptible to repetitive injuries than others, there is no reliable method of determining who is the most vulnerable.

During the last few years, there has been increasing interest throughout the supermarket and merchandising industries in the application of ergonomic principles to the check-out counter system. Retail clerks' unions are becoming active in this area and OSHA has brought the supermarket front-end under scrutiny. However, the supermarket check-out counter systems present ergonomic problems which do not lend themselves to easy solutions.

Nearly all check-out counter systems in the United States and Canada are designed so that cashiers must work in a standing posture. When seating is not available at the check-out counter systems, cashiers report discomfort and pain in the legs, apparently caused by prolonged standing. In contrast, most check-out counter systems in Europe and some other parts of the world are designed so that the cashiers work in a seated position. Studies have shown that prolonged sitting is associated with increased rates of low-back pain, probably caused by rotation of the pelvis.

Working continuously in either a standing or seated position has disadvantages. When working in a standing posture, muscles in the legs, feet and lower back must work constantly to maintain this posture. Heavy loads are placed on the feet. As each major muscle group remains tensed, circulation through these muscles is reduced, nutrient flow to the muscles is restricted, and the chemical products of fatigue build up in the tissues. On the other hand, when working continuously in a seated position, continuous tensing of specific muscle groups occurs. Circulation to the legs is further restricted by pressure from the chair seat. When assuming a seated posture, the lower lumbar curve of the back becomes nearly straight and this rotates all of the vertebra in this section of the back out of their neutral position into a position in which the torso loads are concentrated on the front of each vertebra and disc. The net result is a reduction of the lower back strength of about 30%. When working in a seated position it is physically difficult to handle bulky items and it is impossible to use the legs to assist in lifting heavy items.

In addition, there are two basic types of check-out counter systems, i.e. customer unload and cashier unload. With customer unload check-out counter systems, the customers places his order on the top of the check-out counter so that the cashier can record the price of each item. The top of the check-out is usually provided with a conveyor belt to transport the order to the cashier. The top surface of the customer unload check-out is typically 35 to 38 inches above the surface on which the cashier is standing. With cashier unload check-out counter systems, the cashier removes the customer's order from the shopping cart and records the price of each item. The top surface of the cashier unload check-out is typically 29 to 32 inches above the surface on which the cashier is standing.

With both systems, after the price of each item has been recorded, the customer's order is placed in boxes, paper bags or plastic bags by the cashier or by a professional bagger. The bagging operation is performed on the check-out surface, on a special bagging shelf or platform that is part of the check-out counter system, or on bagging racks which can be placed on either of the above mentioned surfaces or suspended from the end of the check-out counter system. In all cases the bagging surface is fixed at one height above the floor.

In that regard, anthropometric data reveals that the 5th percentile female is just under 5 feet tall and that the 95th percent male is over 6 feet 2 inches tall. When the surface of a work place is at a correct height, the operator is able to work with the upper arms hanging relaxed and the wrist 1 to 4 inches lower than the elbow. It has been found by applying anthropometric data to these requirements that the working surface for a 5 foot tall person should be 34 to 36 inches high and the working surface for a 6 foot 2 inch person should be 41 to 43 inches high. To applicant's knowledge, no check-out counter systems have heretofore recognized or made any allowances for these requirements and differences in human heights of the operator.

All check-out counter systems must have a keyboard to enter price data. These keyboards have been placed in many different locations in check-out counter systems. In some check-out counter systems, the keyboards have been made adjustable up and down relative to the check-out counter and sometimes the angle can be adjusted. However, to applicant's knowledge no one has ever taken into consideration the fact that many people are left-handed. The best location for a keyboard from an ergonomic viewpoint is directly in front of the cashier, at a height and angle that allows the cashier to operate the keyboard with his upper arm hanging in a relaxed position and the wrist within 15 degrees of a neutral (straight) posture. Keyboards mounted in this way are typically placed directly in front of the cashier's right shoulder, since the majority of our population are right-handed. For a left-handed operator to use this keyboard, the left arm must be extended across in front of the body and the left wrist must be bent back to the left at an uncomfortable angle.

It has been found that for maximum productivity when business is light, the most cost-effective and productive system of processing goods at the check-out counter is one in which the cashier grasps each item, records its price (either manually with the keyboard or with the use of a laser scanner), then places it directly in a bag for the customer. This is referred to as "direct bagging". It has the advantage of using only one worker and of handling each item only once. On the other hand, when business becomes heavy, it is advantageous to be able to add manpower, such as a bagger, to the process in order to speed customers through the check-out as fast as possible. Prior check-out counter systems have not been specifically designed to best accommodate both of these procedures.

OBJECT AND SUMMARY OF THE INVENTION

It is an object of this invention to improve the above problems and to provide an ergonomically designed check-out counter system which provides an environment for the cashier and bagger in which provision has been made for the differences in human heights, hand and position of operators and for ease in handling of merchandise to reduce fatigue and injury to operators while providing for maximum productivity under both light and heavy through put requirements in the system.

Accordingly, the check-out counter system of the present invention proposes the incorporation therein of an adjustable floor which will place the cashier of any statue at a comfortable working height. In addition, bagging racks are provided at the end of the check-out counter system to hold plastic grocery bags for use by a bagger and provision is provided for adjusting these racks up and down relative to the floor to allow for differences in human stature.

The check-out counter system of this invention further provides the cashier with the option of sitting or standing. When the cashier can alternate between sitting or standing, this changes the major muscle groups being used to maintain the working posture, allowing circulation to flood into fatigued muscles and restore their energy. The check-out counter system of this invention provides a chair which is mounted on a swinging, telescoping arm so that a seated cashier can easily stand to handle bulky or heavy items. The chair swings out of the way behind the cashier to allow the cashier to move freely. It can then be pulled back into position for seated work. The chair pivots to prevent the twisting of the back. When not in use, the chair can be telescoped into a corner and out of the way.

It has been found that when a seated operator is placed in a posture with his thighs at an angle of 25 to 30 degrees from horizontal rather than horizontal, part of the lumbar curve is restored. In addition, a good lumbar support restores more of the lumbar curve. Restoration of some of the lumbar curve reduces adverse affects of the seated posture. The chair utilized in the check-out counter system of this invention is designed to place the thighs at an angle of 20 to 30 degrees and is provided with a lumbar support which can be adjusted forward to support the lumbar curve even when the operator is leaning forward. Anthropometric data demonstrates that the adjustment range required for seated operators ranging from 5 feet tall to 6 feet 2 inches tall is slightly less than 2 inches. Provision is made for the chair used in the check-out counter system of this invention to be adjustable up and down over a 4 inch range. Additionally, the telescoping arm of the chair is provided with a brake which allows the cashier to rest comfortably and use the lumbar support correctly when working.

In the check-out counter system of this invention, the keyboard is mounted on a pedestal at an adjustable desired height and adjustable angle and includes provisions for being moved between a position in the front of the right shoulder to a position in front of the left shoulder of the cashier facing the keyboard to accommodate right-handed and left-handed cashiers.

In accordance with the present invention, the check-out counter system is capable of maximum productivity under the procedures of "direct bagging" by the cashier or with the use of an additional bagger. When business is light, the cashier may grasp each item in the right hand, record the price, transfer the item to the left hand which then places the item directly in a plastic bag. The check-out counter system has provisions for positioning the bag lower than the counter top so that the item can be slid off of the counter and into the bag without any need for lifting up. Movement is across and down. The bag receiving the item is located directly adjacent to the cashier's left side and slightly forward of the cashier's shoulder so that the natural swing of the cashier's left arm deposits the item in the bag. The bag is held open by two arms on a bag pack rack which pass through holes in the bag's handles. These arms hold the bag such that the bottom of the bag rests on a conveyor belt. The conveyor belt is at such a height that the cashier does not need to bend over to place items in the bag. When the bag is full, the cashier actuates the conveyor belt. Through friction with the bottom of the bag, the conveyor belt pulls the bag off of the supporting arms. As the bag is pulled off the supporting arms, a small deposit of glue on the back of the bag, connecting it to the front surface of the subsequent bag, pulls the subsequent bag open. The conveyor belt may also be placed in a second generally downwardly angled position extending from the countertop of the system for transfer by the cashier of merchandise from the countertop to the conveyor means for conveying to the end of the check-out counter system for bagging by a bagger when business is heavy.

Accordingly, the ergonomically designed check-out counter system of the present invention provides a number of features and advantages not present with prior systems. The check-out counter system of the present invention minimizes reach and strength requirements by keeping the load close and centered on the body as much as possible. It avoids repeated lifting of objects at arms length from the body or extending the arms while supporting a load. It avoids repeated bending or leaning forward by the cashier. The check-out counter system provides for alternative standing or sitting by the cashier and adjustability and proper support in the chair. The check-out counter system locates the cashier and all elements of the system at the correct relative heights so that the worker's arms can hang relaxed and movement of the upper arms can be limited to 60 degrees forward and 45 degrees to the side.

BRIEF DESCRIPTION OF THE DRAWINGS

While some of the objects and advantages of this invention have been set forth above, others will become apparent in the detailed description of a preferred embodiment of the invention to follow, when taken in conjunction with the accompanying drawings, in which.

DETAILED DESCRIPTION OF PREFERRED EMBODIMENT OF THE INVENTION

Figure 1:
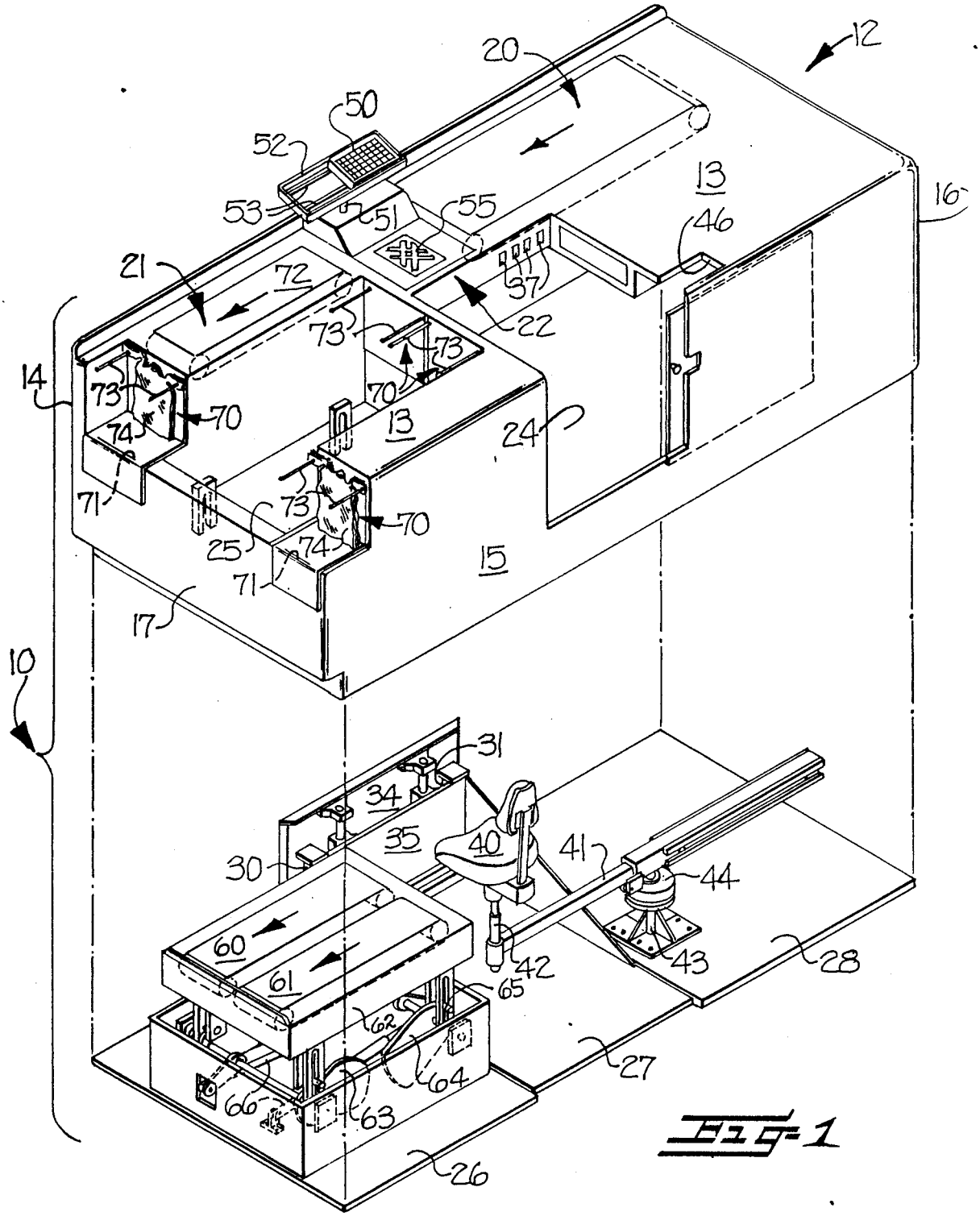
FIG. 1 is an exploded perspective view of the ergonomically designed check-out counter system of this invention.

Referring now to the drawings, there is shown therein a preferred embodiment of an ergonomically designed check-out counter system, for supermarket and merchandising industries, generally indicated at 10, of this invention which includes the improved features discussed broadly above and to be discussed in more detail hereinafter. However, it is to be understood that other embodiments of a check-out counter system could be utilized which incorporate one or more of the improved features of this invention therein.

In FIG. 1, there is shown an exploded view of the ergonomically designed check-out counter system 10, of this invention for supermarket and merchandising industries. This check-out counter system 10 is also shown in perspective in FIGS. 7 and 10 in two different modes of operation, to be discussed more fully below.

The check-out counter system 10 includes an elongate housing 12 having interconnected countertop 13, side wall portions 14, 15 and end wall portions 16, 17 for defining generally the overall shape of the check-out counter system 10. The elongate housing 12 further includes generally an upstream end portion 20 for receiving the merchandise being checked-out, a downstream end portion 21 for bagging the checked-out merchandise and an intermediate portion 22 between the upstream end portion 20 and the downstream end portion 21 for receiving a cashier for checking-out the merchandise. The housing 12 defines an opening 24 in the intermediate portion 22 through at least a portion of the countertop 13 and one of the side wall portions 15 for the positioning of a cashier. The housing 12 further defines an opening 25 in the downstream end portion 21 through a longitudinally extending intermediate area of the countertop 13 for positioning of bagging mechanisms (to be described below).

Figure 3:
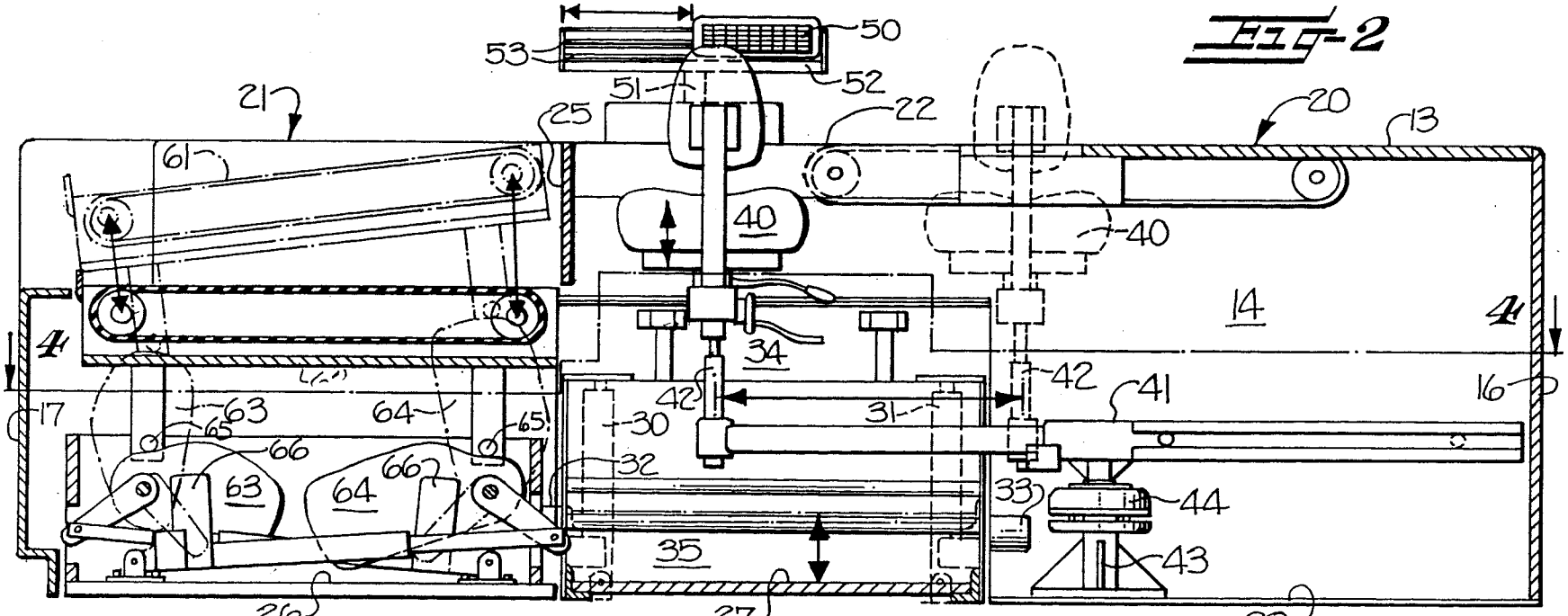
FIG. 3 is a sectional view, taken generally along the line 3—3 of FIG. 2.
Figure 5:
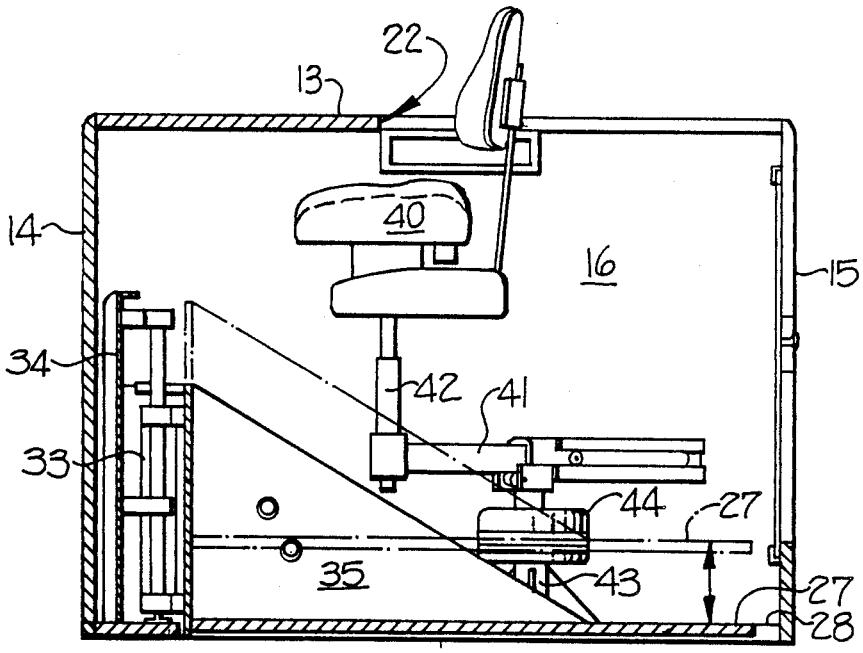
FIG. 5 is a sectional view, taken generally along the line 5—5 of FIG. 4.
Figure 6:
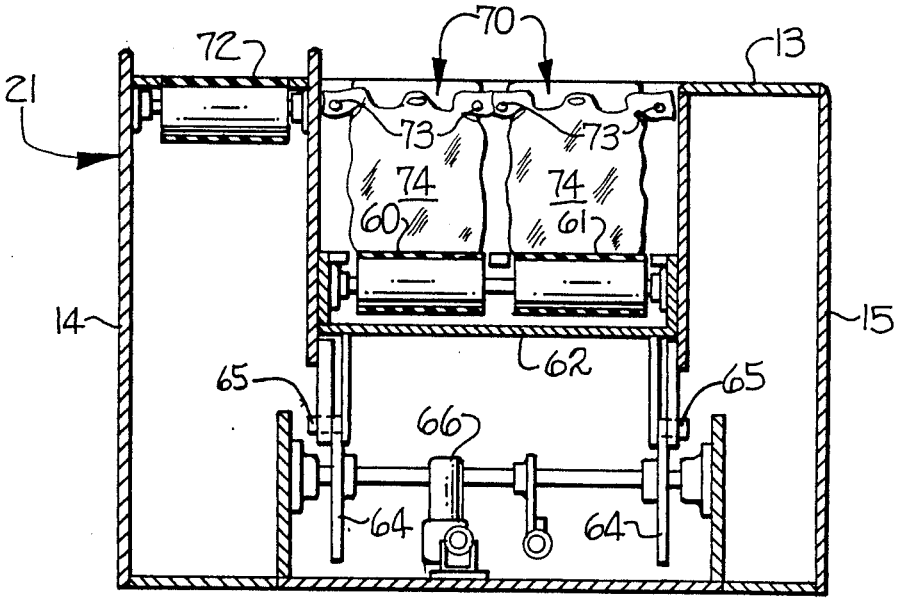
FIG. 6 is a sectional view, taken generally along the line 6—6 of FIG. 4.

The check-out counter system 10 includes a floor, shown as three sections 26, 27 and 28 (FIGS. 1 and 3). However, it is to be understood that one or more of these floor sections 26, 27, 28 could be eliminated and the floor of the environment in which the check-out counter system 10 is placed could be utilized in lieu thereof. The floor section 27 is positioned under the intermediate opening 24 in the housing 12 for receiving the cashier thereon. This floor section 27 includes means for moving this floor section vertically up and down (as shown by the dotted and solid line positions and arrow in FIGS. 3 and 5) to position the cashier at a desired height in the check-out counter system 10 regardless of the human height or stature of the cashier. This means for moving the floor section 27 up and down may be any suitable mechanical mechanism and, as illustrated schematically in the drawings herein, comprises mechanical jack devices 30, 31 driven by reversible motors 32, 33, respectively. The jack devices 30, 31 are secured between stationary frame member 34 and movable frame member 35 secured to the movable floor section 27. Reversible motors 32, 33 may be operator actuated through any suitable controls (not shown) and a switch panel 37 at the cashier position may be provided for actuating such controls.

Figure 2:
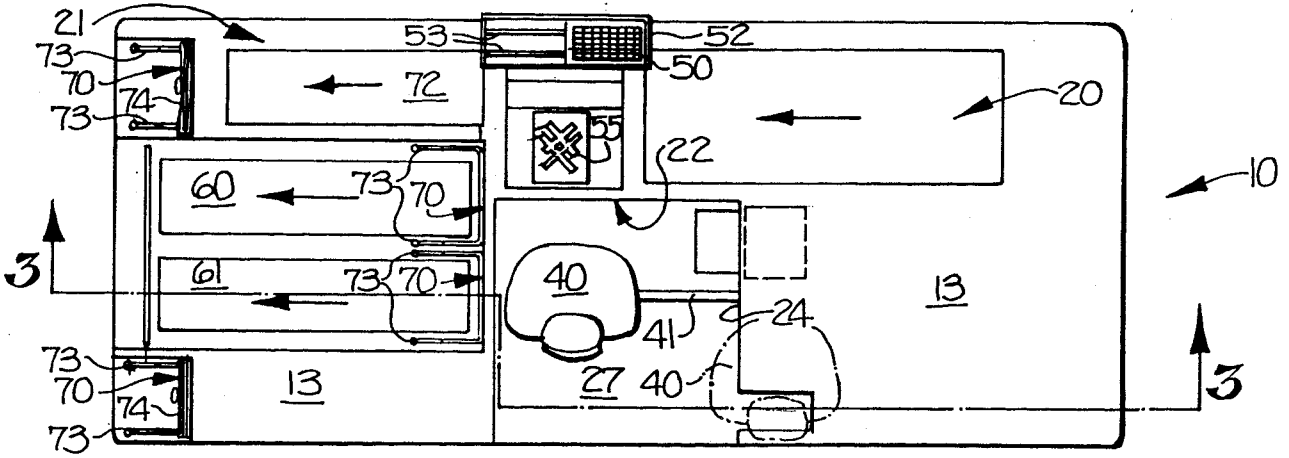
FIG. 2 is a top plan view of the check-out counter system of FIG. 1.
Figure 4:
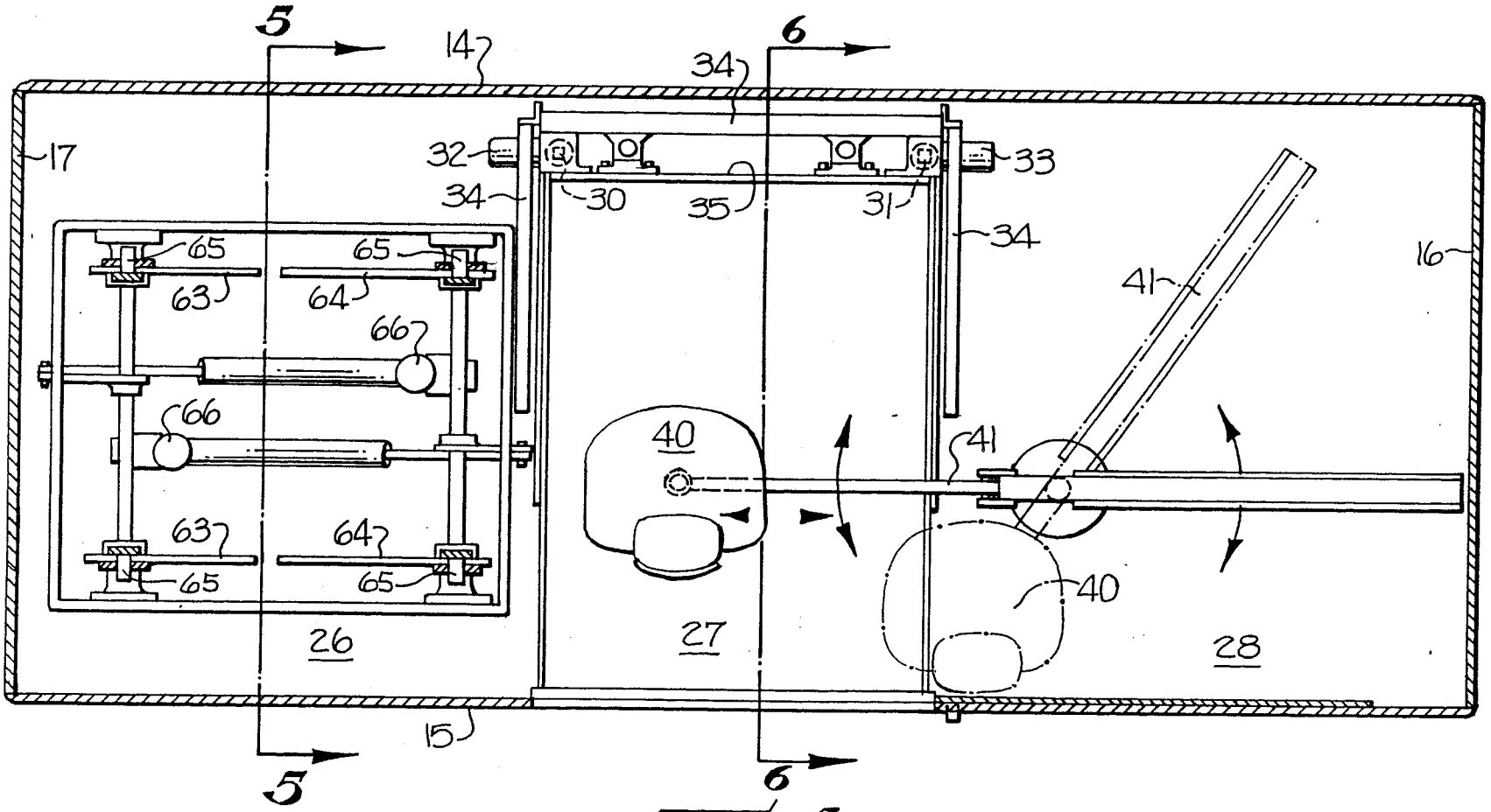
FIG. 4 is a sectional view, taken generally along the line 4—4 of FIG. 3.

The check-out counter system 10 of this invention further includes a movable chair mechanism including a chair 40 positioned in the intermediate opening 24 in the housing 12 above the movable floor section 27 for seating of the cashier. This movable chair mechanism includes means for adjusting the position of the chair 40 vertically relative to the floor section 27 to position the cashier and his legs at desired heights and horizontally from desired positions within the intermediate opening 24 to a position out of the intermediate opening 24 (as shown in solid and dotted line positions and arrows in FIGS. 2, 3 and 4) to provide the cashier with options at sitting at various positions within the intermediate opening 24 or standing.

This means for adjusting the position of the chair 40 may include any suitable mechanical mechanisms and, as illustrated in the drawings hereof, includes a swinging generally horizontally-extending, telescoping arm device 41 for inward and outward movement and for swinging arcuate movement (FIGS. 1, 3, 4 and 5). A first generally vertically-extending shaft device 42 is pivotally carried by and extends upwardly from one end of the telescoping arm device 41 and pivotally carries the chair 40 on the upper end thereof. This shaft device 42 may be a two-part telescoping shaft which allows for vertical adjustment up and down of the shaft device 42 and the chair 40 on the upper end thereof. A second generally vertically-extending shaft device 43 has one end thereof suitably secured to the floor section 28 or rests on the floor of the environment and pivotally carries at the upper end thereof the telescoping arm device 41 at an intermediate location thereon. This second shaft device 43 includes a suitable brake device 44 for stopping and holding the telescoping arm device 41 and, thus, the chair 40 at a desired pivoted or swinging arcuate position within the intermediate opening 24. The brake device 44 may be controlled and operated by any suitable control means (not shown) which may be actuated from the switch panel 37 to brake and lock the seat 40 in a desired position for the cashier. The chair 40 may be any suitable ergonomically-designed chair having a good lumbar support and angled seat with suitable adjustments thereof for supporting the lumbar curve of the cashier and placing the thighs at desired angles, as discussed above.

With these adjustment mechanisms, the chair 40 may be adjusted up and down to accommodate a desired position of the cashier and his legs relative to the movable floor section 27 so that the cashier may assume a full seated position or a nearly standing position while in the chair or any positions therebetween. It has been found that an adjustment range of about 4 inches up and down will accomplish this purpose. Also, the chair 40 may be pivoted around the shaft device 42 so that a seated operator may face in any desired position within the intermediate opening 24 receiving the cashier or the chair 40 may be swung in an arc about the shaft 43 so that the cashier may assume a desired position within the intermediate opening 42. The chair 40 may also be moved entirely out of the intermediate opening 24 and into a cut-out 46 in the housing 12, when the cashier desires to stand.

For checking out the merchandise in the check-out counter system of this invention, there is provided a keyboard device 50 for manually entering price information, etc. into any desired computer or calculator apparatus by the cashier. This keyboard device 50 includes means for mounting the keyboard on the housing 12 in generally the intermediate portion thereof at a desired adjustable height and for generally horizontal movement between a position in front of the right shoulder of the cashier (FIG. 7) to a position in front of the left shoulder of the cashier when facing the keyboard 50 for accommodating both right-handed and left-handed cashiers. This mounting means may include a suitable pedestal 51 extending upwardly to a desired height above the countertop 13 of the housing 12 and a frame 52 having suitable means, such as slide bars 53, therein for movably mounting the keyboard 50 for horizontal back and forth movement. There may also be provided an electronic scanner and scale device 55 for use by the cashier in checking-out merchandise.

The check-out counter system 10 of this invention further includes merchandise bagging mechanisms positioned in the downstream end portion 21 of the housing 12 for bagging of the checked-out merchandise directly by the cashier or by an additional bagger. These bagging mechanisms include a pair of side-by-side longitudinally-extending conveyor belt devices 60, 61 carried by a movable frame member 62 and driven by suitable motors (not shown) in the direction of the arrows in FIG. 1. These conveyor belt devices 60, 61 are positioned in the opening 25 in the downstream end portion 21 for conveying the merchandise away from the cashier and to the end of the check-out counter system 10.

Means are provided for mounting each end of the driven conveyor belt devices 60, 61 for up and down generally vertical movement. The conveyor belt devices 60, 61 may be placed in a first generally horizontal position (FIG. 7) lower than the countertop 13 for receiving a bag at the end thereof adjacent to the cashier for direct bagging by the cashier by sliding the merchandise directly off the countertop 13 and into the bag for conveying of the bagged merchandise away to the end of the check-out counter system 10. The conveyor belt devices 60, 61 may also be placed in a second generally downwardly angled position (FIG. 10) extending from the countertop 13 for transfer by the cashier of the merchandise from the countertop 13 to the conveyor belt devices 60, 61 for conveying to the end of the check-out counter system 10 for bagging by a bagger.

These mechanisms for mounting the conveyor belt devices 60, 61 for the up and down generally vertical movement may include any suitable mechanical mechanisms and, as illustrated in the drawings herein, include cams 63, 64 of desired profiles positioned under each end and each corner of the conveyor belt devices 60, 61 and movable frame member 62 and cam follower devices 65 suitably connected to each end of the frame member 62 carrying the conveyor belts 60, 61 and operatively enqaging the respective cams 63, 64. The cams may be driven for rotation by reversible motors 66 which may be controlled by any suitable control devices (not shown) and actuated from the switch panel 37.

Figure 7:
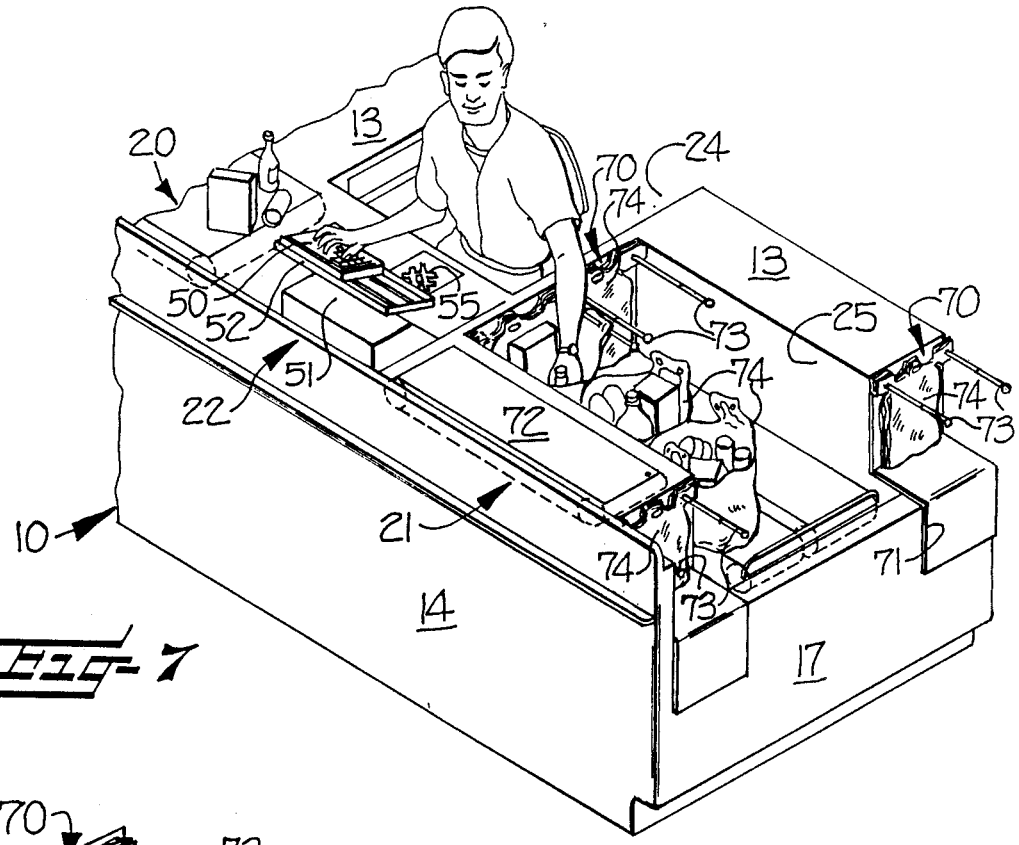
FIG. 7 is a partial perspective view of the check-out counter system of FIG. 1 with components thereof positioned in a direct bagging mode by the cashier.
Figure 10:
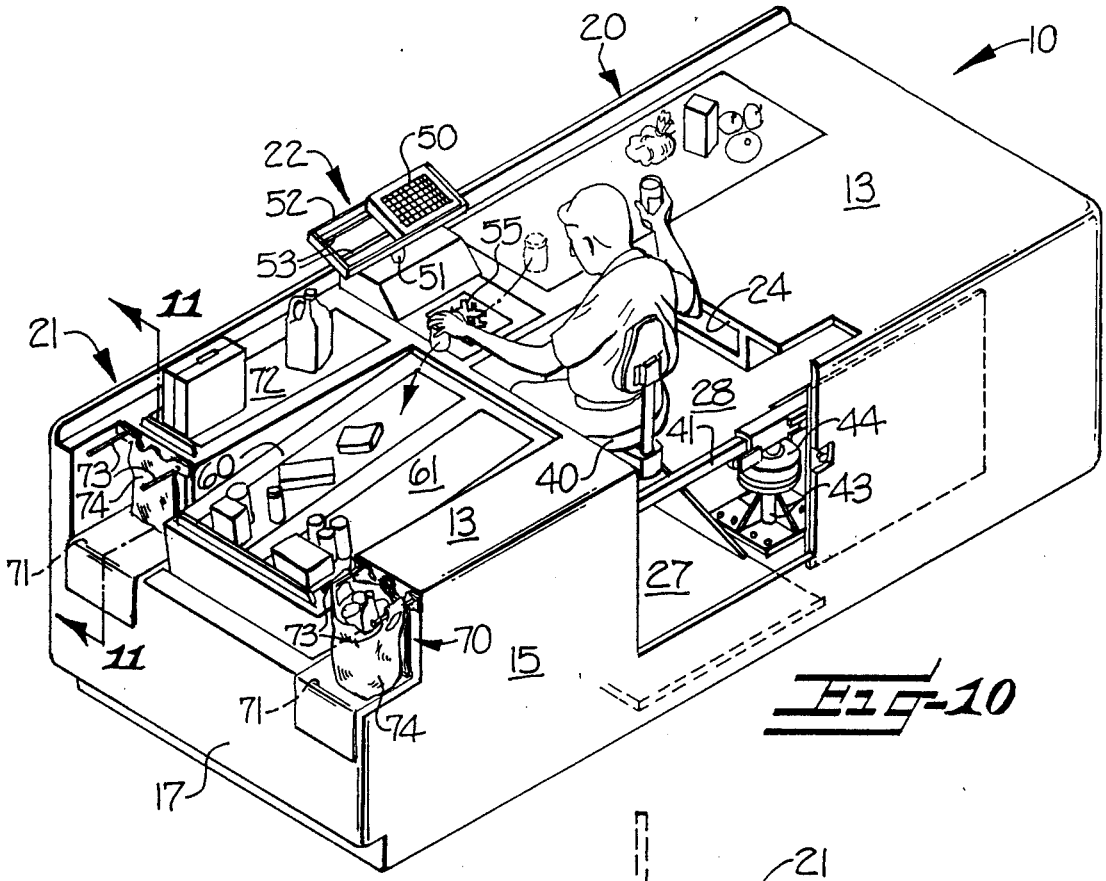
FIG. 10 is a perspective view of the check-out counter system of FIG. 1 showing some of the bagging devices positioned in a mode for bagging by an additional bagger.

The merchandise bagging mechanisms further include plastic bag pack and rack devices 70 of the general construction currently being marketed by the assignee of the present invention under the trademarks QUICKMATE ® and AUTOMATE ® and as shown in issued U.S. Pat. No. 4,676,378 and in pending U.S. application Ser. No. 07/369,459, filed June 21, 1989 of the assignee of the present invention. These plastic bag pack and rack devices 70 are positioned in the opening 25 in the downstream end portion 21 of the housing 12 at the end thereof adjacent to the cashier and over each of the conveyor belt devices 60, 61 in the first position thereof for direct bagging by the cashier (FIG. 7). Plastic bag and rack devices 70 are also positioned on each of the outer ends of the downstream end portion 21 in cut-out portions 71 of the housing 12 for bagging of merchandise by a bagger when the merchandise is conveyed to the end of the check-out counter system 10 by the conveyor belt devices 60, 61 (FIG. 10).

The merchandise bagging devices may further include an additional driven longitudinally-extending conveyor belt 72 positioned in the countertop 13 on one side of the opening 25 in the downstream end portion 21 of the housing 12 for transfer by the casher of large merchandise, i.e. beer, soft drinks, etc., which do not specifically require bagging or which may be bagged by a bagger at plastic bag pack and rack devices 70 at the end of the check-out counter system 10. This conveyor belt 72 eliminates the necessity of the cashier to handle this large merchandise.

Figure 8:
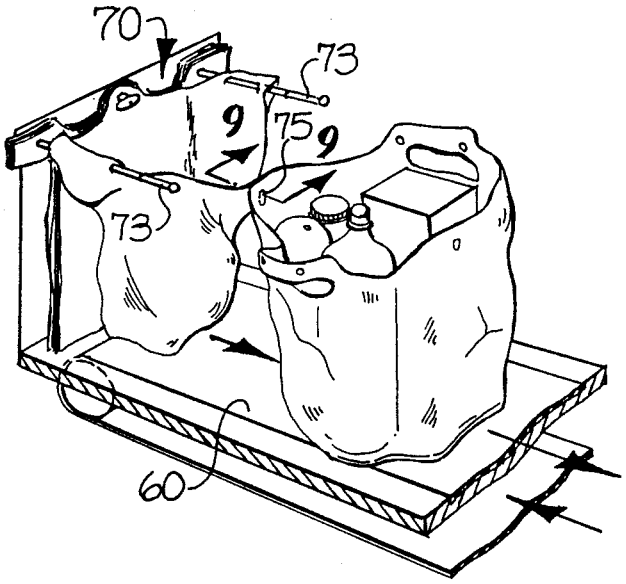
FIG. 8 is an enlarged perspective detail of a portion of the bagging elements of the check-out counter system as shown in FIG. 7.
Figure 9:
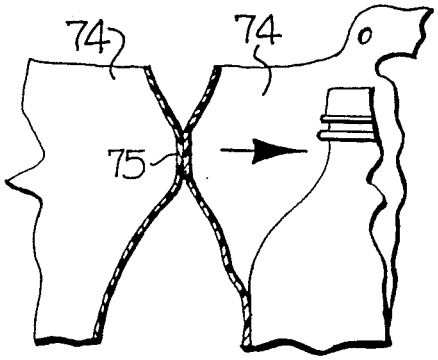
FIG. 9 is a sectional detail, taken generally along the line 9—9 of FIG. 8.

The plastic bag pack and rack devices 70 include outwardly extending arms 73, suitably attached to the housing 12 or to a self-standing frame forming part of the rack, and pass through holes in the handles of bags 74. The bags 74 are adhesively secured together at one or more spots of adhesive 75 (FIGS. 8 and 9) so that as a bag 74 filled with merchandise is removed from the arms 73, the subsequent bag 74 in the bag pack will be moved to an open position on the rack arms 73 before the adhesive connection 75 between bags is broken. The rack arms 73, positioned over the conveyor belt devices 60, 61 hold the bags 74 such that the bottom of the bag 74 rests on a respective conveyor belt 60, 61. When the bag is filled with merchandise, the cashier actuates the conveyor belt 60 or 61 and, through friction with the bottom of the bag 74, the conveyor belt pulls the bag full of merchandise off of the rack arms 73 and the connecting adhesive pulls the subsequent bag into open position before the adhesive connection breaks and the filled bag is conveyed to the end of the check-out counter system 10 for removal. The rack arm 73, positioned over the conveyor belt devices 60, 61 are suitably pivotally mounted for pivoting down out of the way when the conveyor belt devices are moved to the second generally downwardly angled position (FIG. 10).

Figure 11:
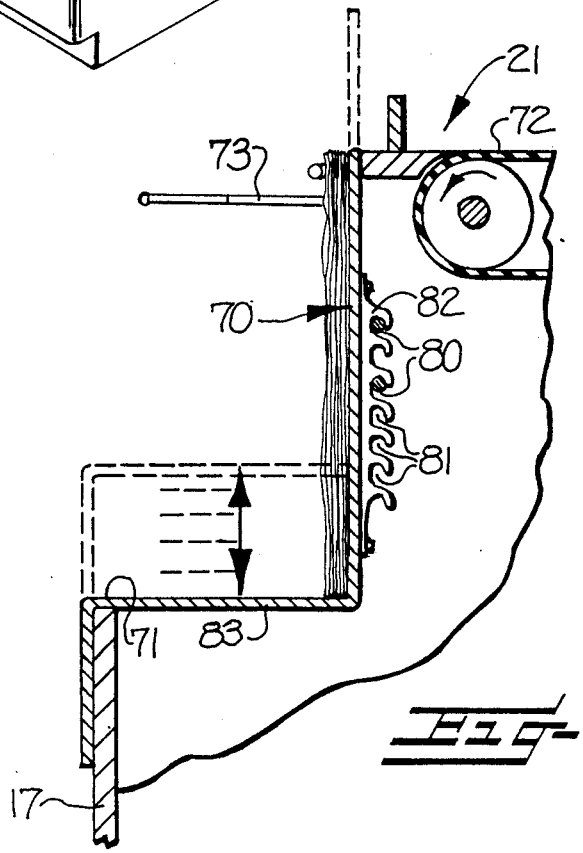
FIG. 11 is a sectional detail, taken generally along the line 11—11 of FIG. 10.

The plastic bag pack and rack devices 70 which are positioned at the end of the check-out counter system 10 include means for vertical adjustment of the height thereof to accommodate different height baggers (FIG. 11). This height adjustment mechanism may be any suitable mechanical devices and, as shown in FIG. 11, includes bars 80 secured in stationary positions on the housing 12 and notches 81 on plates 82 on each side of the rack 83 of the plastic bag and rack device 70.

Thus, the ergonomically design check-out counter system 10 for supermarket and merchandising industries of this invention has been provided with mechanisms to accommodate for differences in human heights, hand and positions of operators and for ease in handling of merchandise to reduce fatigue and injury to the operators while providing maximum productivity under both light and heavy through put requirements.

In the drawings and specification there has been set forth a preferred embodiment of this invention and although specific terms are employed, they are used in a generic and descriptive sense only and not for purposes of limitation, the scope of the invention is defined in the following claims.

What is claimed is:

1. An ergonomically designed check-out counter system for supermarket and merchandising industries characterized by provisions for differences in human heights, hand and position of operators and for ease in handling of merchandise to reduce fatigue and injury to operators while providing maximum productivity under both light and heavy throughput requirements, said check-out counter system comprising:

elongate housing means having interconnected countertop and side and end wall portions for defining generally the overall shape of said check-out counter system including an upstream end portion for receiving the merchandise being checked-out, a downstream end portion for bagging the checked-out merchandise and an intermediate portion between said upstream and downstream end portions for receiving a cashier for checking-out the merchandise, and said housing means having an opening in said intermediate portion through at least a portion of said countertop and one of said side wall portions for the positioning of a cashier and an opening in said downstream end portion through a longitudinally extending intermediate area of said countertop;

movable floor means positioned under said intermediate opening in said housing for receiving the cashier thereon and including means for moving said floor means vertically up and down to position the cashier at a desired height in said check-out counter system regardless of the human height of the cashier;

movable chair means positioned in said intermediate opening in said housing means above said floor means for receiving the cashier and including means for adjusting the position of said chair means vertically relative to said floor means to position the cashier and his legs at desired heights and horizontally from desired positions within said intermediate opening to a position out of said intermediate opening to provide the cashier with the option of sitting at various positions within said intermediate opening or standing;

keyboard means for entering price data of the merchandise by the cashier and including means mounting said keyboard means on said housing means in said intermediate portion at a desired height and for generally horizontal movement between a position in front of the right shoulder to a position in front of the left shoulder of the cashier when facing said keyboard means for accommodating right-handed and left-handed cashiers; and merchandise bagging means positioned in said downstream end portion of said housing means and including driven longitudinally-extending conveyor means positioned in said opening in said downstream end portion for conveying the merchandise away from the cashier and means mounting each end of said driven conveyor means for up and down generally vertical movement, so that said conveyor means may be placed in a first generally horizontal position lower than said countertop for receiving a bag at the end thereof adjacent to the cashier for direct bagging by the cashier by sliding the merchandise directly off said countertop and into the bag for conveying of the bagged merchandise away to the end of said check-out counter system, and so that said conveyor means may be placed in a second generally downwardly angled position extending from said countertop for transfer by the cashier of the merchandise from said countertop to said conveyor means for conveying to the end of said check-out counter system for bagging by a bagger.

2. An ergonomically designed check-out counter system for supermarket and merchandising industries characterized by provisions for differences in human heights, hand and position of operators and for ease in handling of merchandise to reduce fatigue and injury to operators while providing maximum productivity under both light and heavy throughput requirements, said check-out counter system comprising:

elongate housing means having interconnected countertop and side and end wall portions for defining generally the overall shape of said check-out counter system including an upstream end portion for receiving the merchandise being checked-out, a downstream end portion for bagging the checked-out merchandise and an intermediate portion between said upstream and downstream end portions for receiving a cashier for checking-out the merchandise, and said housing means having an opening in said intermediate portion through at least a portion of said countertop and one of said side wall portions for the positioning of a cashier and an opening in said downstream end portion through a longitudinally extending intermediate area of said countertop;

movable chair means positioned in said intermediate opening in said housing means for receiving the cashier and including means for adjusting the position of said chair means vertically relative to said floor means to position the cashier and his legs at desired heights and horizontally from desired positions within said intermediate opening to a position out of said intermediate opening to provide the cashier with the option of sitting at various positions within said intermediate opening or standing; keyboard means for entering price data of the merchandise by the cashier and including means mounting said keyboard means on said housing means in said intermediate portion at a desired height and for generally horizontal movement between a position in front of the right shoulder to a position in front of the left shoulder of the cashier when facing said keyboard means for accommodating right-handed and left-handed cashiers; and merchandise bagging means positioned in said downstream end portion of said housing means and including driven longitudinally-extending conveyor means positioned in said opening in said downstream end portion for conveying the merchandise away from the cashier and means mounting each end of said driven conveyor means for up and down generally vertical movement, so that said conveyor means may be placed in a first generally horizontal position lower than said countertop for receiving a bag at the end thereof adjacent to the cashier for direct bagging by the cashier by sliding the merchandise directly off said countertop and into the bag for conveying of the bagged merchandise away to the end of said check-out counter system, and so that said conveyor means may be placed in a second generally downwardly angled position extending from said countertop for transfer by the cashier of the merchandise from said countertop to said conveyor means for conveying to the end of said check-out counter system for bagging by a bagger.

3. An ergonomically designed check-out counter system for supermarket and merchandising industries characterized by provisions for differences in human heights, hand and position of operators and for ease in handling of merchandise to reduce fatigue and injury to operators while providing maximum productivity under both light and heavy throughput requirements, said check-out counter system comprising:

elongate housing means having interconnected 10 countertop and side and end wall portions for defining generally the overall shape of said check-out counter system including an upstream end portion for receiving the merchandise being checked-out, a downstream end portion for bagging the checked-out merchandise and an intermediate portion between said upstream and downstream end portions for receiving a cashier for checking-out the merchandise, and said housing means having an opening in said intermediate portion through at least a portion of said countertop and one of said side wall portions for the positioning of a cashier and an opening in said downstream end portion through a longitudinally extending intermediate area of said countertop;

movable floor means positioned under said intermediate opening in said housing for receiving the cashier thereon and including means for moving said floor means vertically up and down to position the cashier at a desired height in said check-out counter system regardless of the human height of the cashier;

keyboard means for entering price data of the merchandise by the cashier and including means mounting said keyboard means on said housing means in said intermediate portion at a desired height and for generally horizontal movement between a position in front of the right shoulder to a position in front of the left shoulder of the cashier when facing said keyboard means for accommodating right-handed and left-handed cashiers; and merchandise bagging means positioned in said downstream end portion of said housing means and including driven longitudinally-extending conveyor means positioned in said opening in said downstream end portion for conveying the merchandise away from the cashier and means mounting each end of said driven conveyor means for up and down generally vertical movement, so that said conveyor means may be placed in a first generally horizontal position lower than said countertop for receiving a bag at the end thereof adjacent to the cashier for direct bagging by the cashier by sliding the merchandise directly off said countertop and into the bag for conveying of the bagged merchandise away to the end of said check-out counter system, and so that said conveyor means may be placed in a second generally downwardly angled position extending from said countertop for transfer by the cashier of the merchandise from said countertop to said conveyor means for conveying to the end of said check-out counter system for bagging by a bagger.

4. An ergonomically designed check-out counter system for supermarket and merchandising industries characterized by provisions for differences in human heights, hand and position of operators and for ease in handling of merchandise to reduce fatigue and injury to operators while providing maximum productivity under both light and heavy throughput requirements, said check-out counter system comprising:

elongate housing means having interconnected countertop and side and end wall portions for defining generally the overall shape of said check-out counter system including an upstream end portion for receiving the merchandise being checked-out, a downstream end portion for bagging the checked-out merchandise and an intermediate portion between said upstream and downstream end portions for receiving a cashier for checking-out the merchandise, and said housing means having an opening in said intermediate portion through at least a portion of said countertop and one of said side wall portions for the positioning of a cashier and an opening in said downstream end portion through a longitudinally extending intermediate area of said countertop;

movable floor means positioned under said intermediate opening in said housing for receiving the cashier thereon and including means for moving said floor means vertically up and down to position the cashier at a desired height in said check-out counter system regardless of the human height of the cashier;

movable chair means positioned in said intermediate opening in said housing means above said floor means for receiving the cashier and including means for adjusting the position of said chair means vertically relative to said floor means to position the cashier and his legs at desired heights and horizontally from desired positions within said intermediate opening to a position out of said intermediate opening to provide the cashier with the option of sitting at various positions within said intermediate opening or standing; and merchandise bagging means positioned in said downstream end portion of said housing means and including driven longitudinally-extending conveyor means positioned in said opening in said downstream end portion for conveying the merchandise away from the cashier and means mounting each end of said driven conveyor means for up and down generally vertical movement, so that said conveyor means may be placed in a first generally horizontal position lower than said countertop for receiving a bag at the end thereof adjacent to the cashier for direct bagging by the cashier by sliding the merchandise directly off said countertop and into the bag for conveying of the bagged merchandise away to the end of said check-out counter system, and so that said conveyor means may be placed in a second generally downwardly angled position extending from said countertop for transfer by the cashier of the merchandise from said countertop to said conveyor means for conveying to the end of said check-out counter system for bagging by a bagger.

5. An ergonomically designed check-out counter system for supermarket and merchandising industries characterized by provisions for differences in human heights, hand and position of operators and for ease in handling of merchandise to reduce fatigue and injury to operators while providing maximum productivity under both light and heavy throughput requirements, said check-out counter system comprising:

elongate housing means having interconnected countertop and side and end wall portions for defining generally the overall shape of said check-out counter system including an upstream end portion for receiving the merchandise being checked-out, a downstream end portion for bagging the checked-out merchandise and an intermediate portion between said upstream and downstream end portions for receiving a cashier for checking-out the merchandise, and said housing means having an opening in said intermediate portion through at least a portion of said countertop and one of said side wall portions for the positioning of a cashier;

movable floor means positioned under said intermediate opening in said housing for receiving the cashier thereon and including means for moving said floor means vertically up and down to position the cashier at a desired height in said check-out counter system regardless of the human height of the cashier;

movable chair means positioned in said intermediate opening in said housing means above said floor means for receiving the cashier and including means for adjusting the position of said chair means vertically relative to said floor means to position the cashier and his legs at desired heights and horizontally from desired positions within said intermediate opening to a position out of said intermediate opening to provide the cashier with the option of sitting at various positions within said intermediate opening or standing; and keyboard means for entering price data of the merchandise by the cashier and including means mounting said keyboard means on said housing means in said intermediate portion at a desired height and for generally horizontal movement between a position in front of the right shoulder to a position in front of the left shoulder of the cashier when facing said keyboard means for accommodating right-handed and left-handed cashiers.

6. An ergonomically designed check-out counter system for supermarket and merchandising industries characterized by provisions for differences in human heights, hand and position of operators and for ease in handling of merchandise to reduce fatigue and injury to operators while providing maximum productivity under both light and heavy throughput requirements, said check-out counter system comprising:

elongate housing means having interconnected countertop and side and end wall portions for defining generally the overall shape of said check-out counter system including an upstream end portion for receiving the merchandise being checked-out, a downstream end portion for bagging the checked-out merchandise and an intermediate portion between said upstream and downstream end portions for receiving a cashier for checking-out the merchandise, and said housing means having an opening in said intermediate portion through at least a portion of said countertop and one of said side wall portions for the positioning of a cashier;

movable floor means positioned under said intermediate opening in said housing for receiving the cashier thereon and including means for moving said floor means vertically up and down to position the cashier at a desired height in said check-out counter system regardless of the human height of the cashier; and movable chair means positioned in said intermediate opening in said housing means above said floor means for receiving the cashier and including means for adjusting the position of said chair means vertically relative to said floor means to position the cashier and his legs at desired heights and horizontally from desired positions within said intermediate opening to a position out of said intermediate opening to provide the cashier with the option of sitting at various positions within said intermediate opening or standing.

7. An ergonomically designed check-out counter system, as set forth in claim 1, 2, 4, 5 or 6, in which said means for adjusting the position of said chair means comprises a generally horizontally-extending telescoping arm means for inward and outward movement, first generally vertically-extending shaft means pivotally carried by and extending upwardly from one end of said telescoping arm means and pivotally carrying said chair means on the upper end thereof and including means for vertical adjustment up and down of said chair means, and second generally vertically-extending shaft means pivotally carrying at the upper end thereof said telescoping arm means at an intermediate location thereon and including brake means for stopping and holding said telescoping arm means and said chair means at a desired pivoted position.

8. An ergonomically designed check-out counter system, as set forth in claim 1, 2, 3 or 4, in which said means for mounting each end of said driven conveyor means of said merchandise bagging means for up and down generally vertical movement comprises driven cam means of desired profiles positioned under each end of said conveyor means and cam follower means connected to each end of said conveyor means and operatively engaging said respective cam means.

9. An ergonomically designed check-out counter system, as set forth in claim 1, 2, 3 or 4, in which said bagging means further includes plastic bag pack and rack means positioned in said opening in said downstream end portion of said housing means at the end thereof adjacent to the cashier and cooperating with said conveyor means in the first position thereof for direct bagging by the cashier, and plastic bag pack and rack means positioned on the end of said downstream end portion of said housing means for bagging of the merchandise conveyed by said conveyor means when in the second position thereof.

10. An ergonomically designed check-out counter system, as set forth in claim 9, in which said plastic bag pack and rack means positioned on the end of said downstream end portion of said housing means includes means for vertical adjustment of the height thereof to accommodate different height baggers.

11. An ergonomically designed check-out counter system, as set forth in claim 9, in which said bagging means further includes an additional driven longitudinally-extending conveying means positioned in said countertop on one side of said opening in said downstream end portion of said housing means for transfer by the cashier of large merchandise not specifically requiring bagging to be conveyed to the end of said check-out counter system.

12. An ergonomically designed check-out counter system, as set forth in claim 1, 2, 3, 4, 5 or 6, further including driven longitudinally-extending conveyor means positioned in said countertop in said upstream end portion for receiving merchandise being unloaded for check-out and conveying such merchandise to the cashier.

13. In an ergonomically designed check-out counter system having an elongate housing including interconnected countertop and side and end wall portions for defining generally the overall shape of the check-out counter system and including an upstream end portion for receiving the merchandise being checked-out, a downstream end portion for bagging the checked-out merchandise and an intermediate portion between the upstream and downstream end portions for receiving a cashier for checking-out the merchandise, the housing defining an opening in the intermediate portion through at least a portion of the countertop and one of the side wall portions for the positioning of a cashier; the improvement therein of:

movable floor means positioned under the intermediate opening in the housing for receiving the cashier thereon and including means for moving said floor means vertically up and down to position the cashier at a desired height in said check-out counter system regardless of the human height of the cashier.

14. In an ergonomically designed check-out counter system having an elongate housing including interconnected countertop and side and end wall portions for defining generally the overall shape of the check-out counter system and including an upstream end portion for receiving the merchandise being checked-out, a downstream end portion for bagging the checked-out merchandise and an intermediate portion between the upstream and downstream end portions for receiving a cashier for checking-out the merchandise, the housing defining an opening in the intermediate portion through at least a portion of the countertop and one of the side wall portions for the positioning of a cashier; the improvement therein of:

movable chair means positioned in the intermediate opening in the housing for receiving the cashier and including means for adjusting the position of said chair means vertically to position the cashier and his legs at desired heights and horizontally from desired positions within the intermediate opening to a position out of the intermediate opening to provide the cashier with the option of sitting at various positions within the intermediate opening or standing, said means for adjusting the position of said chair means comprises a generally horizontally-extending telescoping arm means for inward and outward movement, first generally vertically-extending shaft means pivotally carried by and extending upwardly from one end of said telescoping arm means and pivotally carrying said chair means on the upper end thereof and including means for vertical adjustment up and down of said chair means, and second generally vertically-extending shaft means pivotally carrying at the upper end thereof said telescoping arm means at an intermediate location thereon and including brake means for stopping and holding said telescoping arm means and said chair means at a desired pivoted position.

15. An ergonomically designed check-out counter system, as set forth in claim 1, 2, 3 or 4, in which said bagging means further includes second conveyor belt means positioned in said housing generally at the level of said counter top for conveying of merchandise selected by the cashier for bagging by a customer or bag boy while said first conveyor means is in the first position thereof for bagging of other selected merchandise by the cashier.

16. In an ergonomically designed check-out counter system for supermarket and merchandising industries having an elongate housing including interconnected countertop and side and end wall portions for defining generally the overall shape of the check-out counter system and including an upstream end portion for receiving the merchandise being checked-out, a downstream end portion for bagging the checked-out merchandise and an intermediate portion between said upstream and downstream end portions for receiving a cashier for checking-out the merchandise; the improvement therein of:

keyboard means for entering price data of the merchandise by the cashier and including means mounting said keyboard means on the housing in the intermediate portion at a desired height and for generally horizontal movement between a position in front of the right shoulder to a position in front of the left shoulder of the cashier when facing said keyboard means for accommodating right-handed and left-handed cashiers.

17. In an ergonomically designed check-out counter system for supermarket and merchandising industries having an elongate housing including interconnected countertop and side and end wall portions for defining generally the overall shape of the check-out counter system and including an upstream end portion for receiving the merchandise being checked-out, a downstream end portion for bagging the checked-out merchandise and an intermediate portion between said upstream and downstream end portions for receiving a cashier for checking-out the merchandise, the housing defining an opening in the downstream end portion through a longitudinally-extending intermediate area of the countertop; the improvement therein of:

merchandise bagging means positioned in the downstream end portion of the housing means and including driven longitudinally-extending conveyor means positioned in the opening in the downstream end portion for conveying the merchandise away from the cashier and means mounting each end of said driven conveyor means for up and down generally vertical movement, so that said conveyor means may be placed in a first generally horizontal position lower than the countertop of the housing for receiving a bag at the end thereof adjacent to the cashier for direct bagging by the cashier by sliding the merchandise directly off the countertop and into the bag for conveying of the bagged merchandise away to the end of the check-out counter system, and so that said conveyor means may be placed in a second generally downwardly angled position extending from the countertop for transfer by the cashier of the merchandise from the countertop to said conveyor means for conveying to the end of the check-out counter system for bagging by a bagger.

18. In an ergonomically designed check-out counter system, as set forth in claim 17, in which said means for mounting each end of said driven conveyor means of said merchandise bagging means for up and down generally vertical movement comprises driven cam means of desired profiles positioned under each end of said conveyor means and cam follower means connected to each end of said conveyor means and operatively engaging said respective cam means.

19. In an ergonomically designed check-out counter system, as set forth in claim 17, in which said bagging means further includes plastic bag pack and rack means positioned in said opening in said downstream end portion of said housing means at the end thereof adjacent to the cashier and cooperating with said conveyor means in the first position thereof for direct bagging by the cashier, and plastic bag pack and rack means positioned on the end of said downstream end portion of said housing means for bagging of the merchandise conveyed by said conveyor means when in the second position thereof.

20. In an ergonomically designed check-out counter system, as set forth in claim 19, in which said plastic bag pack and rack means positioned on the end of said downstream end portion of said housing means includes means for vertical adjustment of the height thereof to accommodate different height baggers.

21. In an ergonomically designed check-out counter system, as set forth in claim 17, 18 or 19, in which said bagging means further includes an additional driven longitudinally-extending conveying means positioned in said countertop on one side of said opening in said downstream end portion of said housing means for transfer by the cashier of large merchandise not specifically requiring bagging to be conveyed to the end of said check-out counter system.

22. In an ergonomically designed check-out counter system for supermarket and merchandising industries having an elongate housing including interconnected countertop and side and end wall portions for defining generally the overall shape of the check-out counter system and including an upstream end portion for receiving the merchandise being checked-out, a downstream end portion for bagging the checked-out merchandise and an intermediate portion between said upstream and downstream end portions for receiving a cashier for checking-out the merchandise, the housing defining an opening in the downstream end portion through a longitudinally-extending intermediate area of the countertop; the improvement therein of:

merchandise bagging means positioned in the downstream end portion of the housing and including first driven longitudinally-extending conveyor means portioned in the opening in the downstream end portion at a generally horizontal position lower than the countertop of the housing for receiving a bag at the end thereof adjacent to the cashier for direct bagging by the cashier and for conveying of the bagged merchandise away to the end of the check-out counter system, and a second driven longitudinally-extending conveyor belt means positioned in said housing at a generally horizontal position at generally the level of said countertop for conveying of checked merchandise selected by the cashier for bagging by a customer or bag boy at the end of said countertop while the cashier is bagging other merchandise on said first conveyor belt means.

* * * * *